US007363886B2

(12) United States Patent
Akaike et al.

(10) Patent No.: US 7,363,886 B2
(45) Date of Patent: Apr. 29, 2008

(54) POWER UNIT

(75) Inventors: Junichi Akaike, Chofu (JP); Tomoko Tada, Hamura (JP); Tadashi Kamoshita, Nishitokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 11/405,556

(22) Filed: Apr. 18, 2006

(65) Prior Publication Data

US 2006/0185628 A1 Aug. 24, 2006

(30) Foreign Application Priority Data

Apr. 27, 2005 (JP) ..... 2005-129113

(51) Int. Cl.
*F01P 7/04* (2006.01)

(52) U.S. Cl. ..... 123/41.65; 123/41.7; 123/185.3

(58) Field of Classification Search ..... 123/41.65, 123/41.7, 41.56, 41.63, 41.49, 185.1, 185.3
See application file for complete search history.

(56) References Cited

U.S. PATENT DOCUMENTS 3,183,899 A * 5/1965 Tuggle ..... 123/41.65
3,994,067 A * 11/1976 Hazzard et al. ..... 30/383
4,189,919 A * 2/1980 Goscenski, Jr. ..... 60/420
4,417,636 A * 11/1983 Mazur ..... 180/68.4
4,445,583 A * 5/1984 Mazur ..... 180/68.1
4,546,843 A * 10/1985 Koinuma et al. ..... 180/229
4,632,070 A * 12/1986 Onda et al. ..... 123/41.58
4,647,835 A * 3/1987 Fujikawa et al. ..... 322/1
4,934,448 A * 6/1990 Uemura et al. ..... 165/41
4,953,526 A * 9/1990 Hironaka et al. ..... 123/182.1
5,029,393 A * 7/1991 Nagashima et al. ..... 30/383
5,370,586 A * 12/1994 Thomsen et al. ..... 474/135
5,457,846 A * 10/1995 Kuwano et al. ..... 15/339
5,927,094 A * 7/1999 Nickum ..... 62/259.2
5,950,578 A * 9/1999 Hirano et al. ..... 123/41.65
6,178,931 B1 * 1/2001 Durr ..... 123/41.65
6,305,333 B1 * 10/2001 Maruta et al. ..... 123/41.49
6,405,690 B1 * 6/2002 Eder ..... 123/41.56
6,523,508 B2 * 2/2003 Husges et al. ..... 123/41.65
6,585,035 B2 * 7/2003 Zobel et al. ..... 165/43
6,640,764 B2 * 11/2003 Tezuka et al. ..... 123/192.2
6,679,218 B2 * 1/2004 Kragner et al. ..... 123/185.3
6,889,635 B2 * 5/2005 Geisheker et al. ..... 123/41.65
6,925,970 B2 * 8/2005 Liu et al. ..... 123/41.69
7,017,917 B2 * 3/2006 Ito et al. ..... 277/591
2001/0035282 A1 * 11/2001 Zobel et al. ..... 165/120
2003/0013567 A1 * 1/2003 Kern et al. ..... 474/32
2006/0169256 A1 * 8/2006 Lavender et al. ..... 123/559.1
2006/0288970 A1 * 12/2006 Miyake et al. ..... 123/41.65

FOREIGN PATENT DOCUMENTS

JP 2-10299 3/1990

* cited by examiner

*Primary Examiner*—Hai Huynh
(74) *Attorney, Agent, or Firm*—Pillsbury Winthrop Shaw Pittman, LLP

(57) ABSTRACT

To achieve improved cooling in a power unit, a first fan is coupled with an end of a crankshaft of an internal combustion engine to cool at least a cylinder of the internal combustion engine, and a second fan is coupled with another end of the crankshaft to cool at least the cylinder. The cylinder is cooled by the air supplied from the first fan and the second fan.

4 Claims, 4 Drawing Sheets

POWER UNIT

CROSS REFERENCE TO RELATED APPLICATIONS

This application claims the benefit of priority of Japanese Patent Application No. 2005-129113, filed in Japan on Apr. 27, 2005. The entire contents of this application is incorporated herein by reference.

BACKGROUND OF THE INVENTION

1. Field of the Invention

The present invention relates to a power unit, and more particularly, to a power unit including a small air-cooled internal combustion engine suitable as a component of a portable or hand-held powered working machine.

2. Description of the Related Art

A power unit including a small air-cooled internal combustion engine is widely used as a power source for a portable or hand-held powered working machine.

In the power unit, it is a necessity that the internal combustion engine be sufficiently cooled. Ordinarily, a magneto rotor fixed on a crank shaft functions as a fan by including thereon fan blades such that the internal combustion engine is cooled by air supplied to the periphery of a cylinder thereof. Japanese Examined Utility Model Application Publication No. 2-10299 discloses that fan blades may also be disposed on a start pulley that is part of a recoil starter, in addition to fan blades disposed on the magneto rotor.

However, in that prior art, the fan blades disposed on the start pulley are disposed in such a way so as to cool the recoil starter, but not the internal combustion engine.

SUMMARY OF THE INVENTION

An object of the present invention, which was developed in view of the above circumstances, is to provide a power unit that improves the cooling capability of an air-cooled internal combustion engine.

To achieve the above object, the power unit according to the present invention includes an air-cooled internal combustion engine that has a first fan coupled with a first end of a crankshaft of the internal combustion engine for cooling at least a cylinder of the internal combustion engine, and a second fan coupled with a second end of the crankshaft for also cooling at least the cylinder.

In the power unit, the cylinder is cooled by both the air supplied from the first fan and the air supplied from the second fan. Accordingly, cooling performance is improved as compared to a case in which the cylinder is cooled by only a single fan. Further, coupling the fans to both ends of the crankshaft advantageously reduces the vibration of the power unit by adjusting the dynamic balance of the crankshaft when it rotates by properly distributing the weights of the fans therebetween.

As a preferable embodiment, the power unit may include an air flow guide for causing the air flow generated by the second fan to flow together with the air flow generated by the first fan after it cools the cylinder, as well as guiding the resulting confluent air flow to an exhaust muffler of the internal combustion engine. With this arrangement, since the air flow generated by the first fan and the air flow generated by the second fan can be prevented from stagnating around the cylinder, the cooling property of the internal combustion engine is improved. Also, since the air flows generated by the first and second fans contribute to cooling the exhaust muffler after they cool the cylinder, the overall cooling capability of the internal combustion engine can be further improved.

As another preferable embodiment, the power unit may have an intake port interposed between a crank case for rotatably supporting the crankshaft and the second fan, and the second fan may include a disc fixed to the crankshaft and a multiplicity of blades formed to, or disposed on, the surface of the disc on the crank case side thereof. In this case, when the second fan is rotated by the rotation of the crankshaft, cooling air is intaken from the intake port into a machine body by the action of the multiplicity of blades and contributes to cooling the cylinder. In addition to the above arrangement, since the intake port is interposed between the crank case and the second fan, the crank case is cooled by the air intaken from the intake port, such that an oil seal and a bearing portion between the crank case and the crank shaft are also effectively cooled, thereby improving durability of the engine.

As a preferable embodiment, the power unit may have a partition wall disposed adjacent the blades to partition between the crank case and the blades and to form a suction port between it and the crank case. In this case, the air from the intake port is intaken to the blades side from a narrow gap between the partition wall and the blades so as to bypass the partition wall. Accordingly, the intake efficiency and the air supply efficiency of the second fan can be improved, such that the cooling capability of the internal combustion engine can be improved even further.

As a preferable embodiment, the power unit may have an adaptor including the partition wall and at least a part of the air supply guide arragned integrally therewith. This arrangement is preferable because assembly of the power unit can be simplified and the number of parts can be reduced.

As a preferable embodiment, the second fan may also act as a ratchet pawl holder for transmitting the rotation of a starter reel constituting the recoil starter, and a starter case rotatably supporting the starter reel may be attached to the adaptor. With this configuration, the arrangement of the power unit can be made compact, which helps to reduce the size and weight of the power unit.

DESCRIPTION OF THE PREFERRED EMBODIMENTS

A power unit according to the present invention will be explained in the context of a power source for a hand-held power blower, i.e., a portable working machine. The power blower is a known working machine suitably applied to a job for blowing and gathering fallen leaves, and the like.

Figure 1:
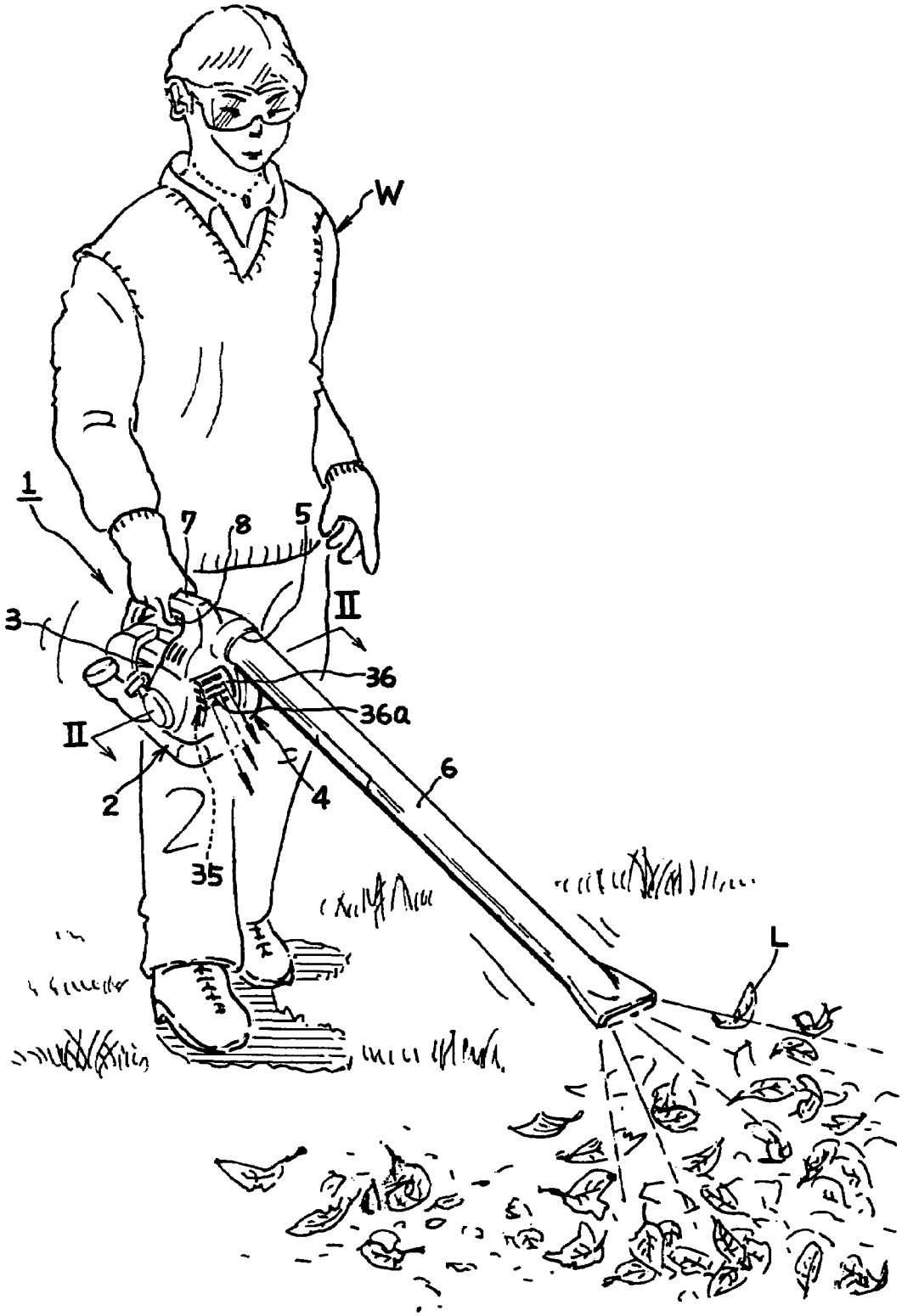
FIG. 1 is an overall perspective view of a hand-held power blower according to an embodiment of the present invention.

As shown in FIG. 1, a machine body 2 of the hand-held power blower 1 includes a power unit 3, a centrifugal blower 4 acting as a working unit driven by the power unit 3 and having a central intake port 4*a*, and a blower pipe 6 connected to an air delivery port 5 of the blower 4. The hand-held power blower 1 includes a handle 7, which permits a worker W to hold the machine body 2 with one hand, and a throttle trigger 8, which can be manipulated by a finger of the hand gripping the handle 7, attached thereto.

The worker W can carry out a job for blowing and gathering fallen leaves L, and the like by the strong air blown from the blower pipe 6 while controlling the output of the power unit 3 by the throttle trigger 8.

Figure 2:
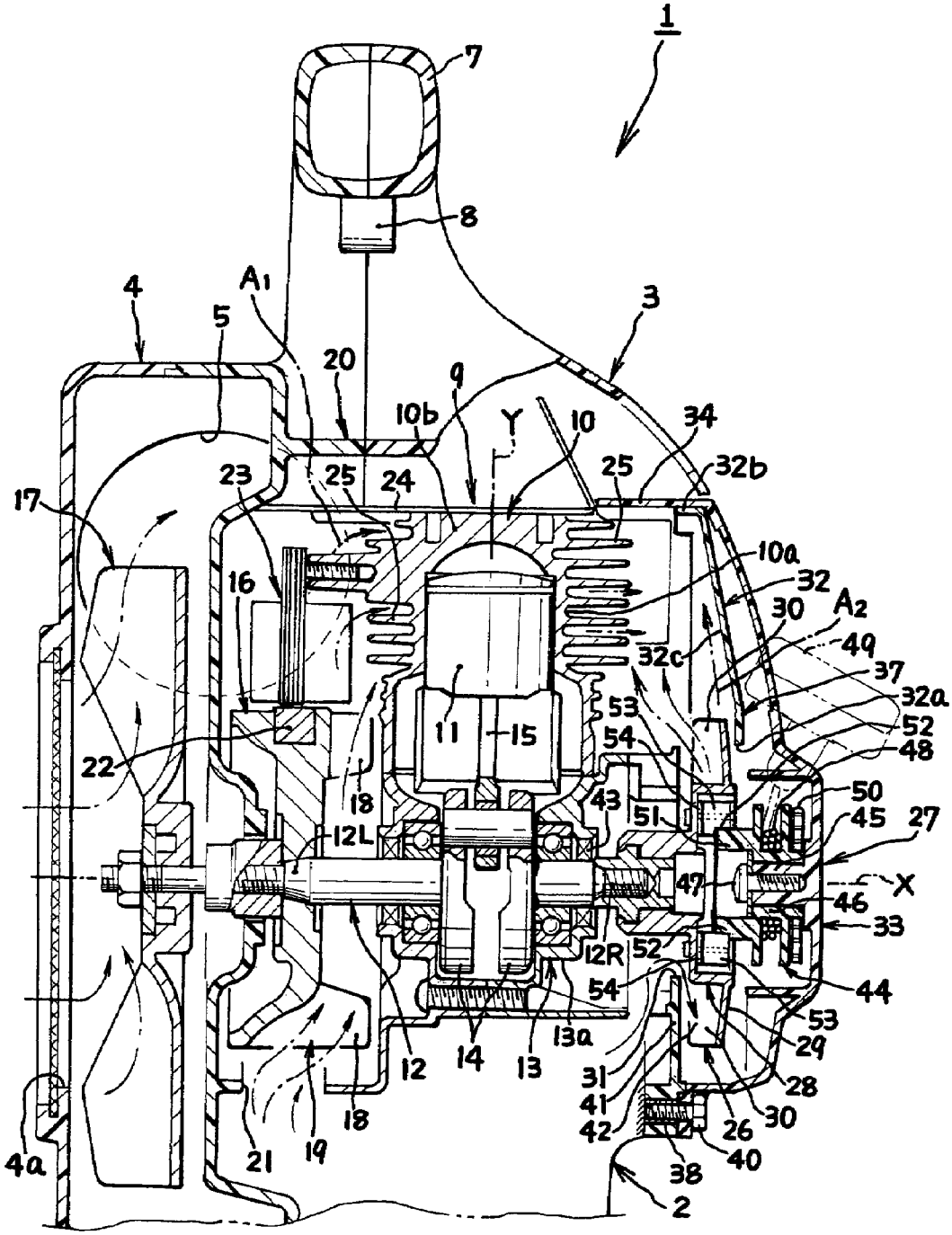
FIG. 2 is a sectional view taken along the II-II of FIG. 1.

As shown in FIG. 2, the power unit 3 includes an air-cooled small internal combustion engine 9 as shown in FIG. 2. The internal combustion engine 9 includes a known type of crankshaft 12 for reciprocating a piston 11 in a cylinder 10. The crankshaft 12 is rotatably supported in a crank case 13 and has a counterweight 14 arranged integrally therewith. When the crankshaft 12 is rotated by the reciprocating motion of the piston 11 through a connecting rod 15, the counterweight 14 causes balance force to act in an opposite direction in correspondence to the rotation of the crankshaft 12.

A left end 12L of the crankshaft 12 projects externally leftward of the crank case 13 and has a magneto rotor 16 and a centrifugal fan 17 of the blower 4 fixed thereto. The magneto rotor 16 has a multiplicity of first blades 18 on the surface thereof on the crank case 13 side integrally therewith so that it also acts as a first fan 19 for supplying air for cooling at least the cylinder 10. The first fan 19 intakes ambient air from a first intake port 21 formed on a lower portion of a machine body case 20 of the power unit 3 in response to the rotation of the crankshaft 12 and supplies the air toward a magneto coil 23 disposed left of the cylinder 10 in confrontation with a magnet 22 fixed on the outer peripheral surface of the magneto rotor 16. An air flow A1 generated by the first fan 19 is guided by the inner surface of a cylinder cover 24 that also acts as an air supply guide, flows in a horizontally right direction while coming into contact with a multiplicity of cooling fins 25 formed on the outer peripheral surface of the cylinder 10, and cools the approximately entire portion of the cylinder 10.

In contrast, a right end 12R of the crankshaft 12 projects externally rightward of the crank case 13 and has a second fan 26 fixed thereto. The second fan 26 supplies air for cooling at least the cylinder 10. In the embodiment, the second fan 26 also acts as a ratchet pawl holder 28 that constitutes a recoil starter 27 for starting the internal combustion engine 9. That is, the second fan 26 includes a disc 29 relatively unrotatably fixed to the crankshaft 12 and a multiplicity of second blades 30 formed on the surface of the disc 29 on the crank case 13 side thereof. The ratchet pawl holder 28 is formed at the center of the disc 29 in a cup-shape. Accordingly, it can be also said that the second fan 26 is arranged by forming the disc 29 and the multiplicity of second blades 30 to the ratchet pawl holder 28 integrally therewith. Otherwise, it can be also said that the ratchet pawl holder 28 also acts as the second fan 26.

The second fan 26 intakes ambient air from a second intake port 31 between the lower portion of the crank case 13 and the lower portion of the second fan 26 in response to the rotation of the crankshaft 12 and supplies the air toward the cylinder 10. An air flow A2 generated by the second fan 26 is guided obliquely upward by a side guide 32 confronting the right outer side surface 10*a* of the cylinder 10 and mainly cools the right outer side surface 10*a* of the cylinder 10. Since the right outer side surface 10*a* is a portion that is unlike to be sufficiently cooled when it is cooled only by the air supplied by the first fan 19, the cylinder 10 can be more effectively cooled in its entirety by the provision of the second fan 26.

Figure 3:
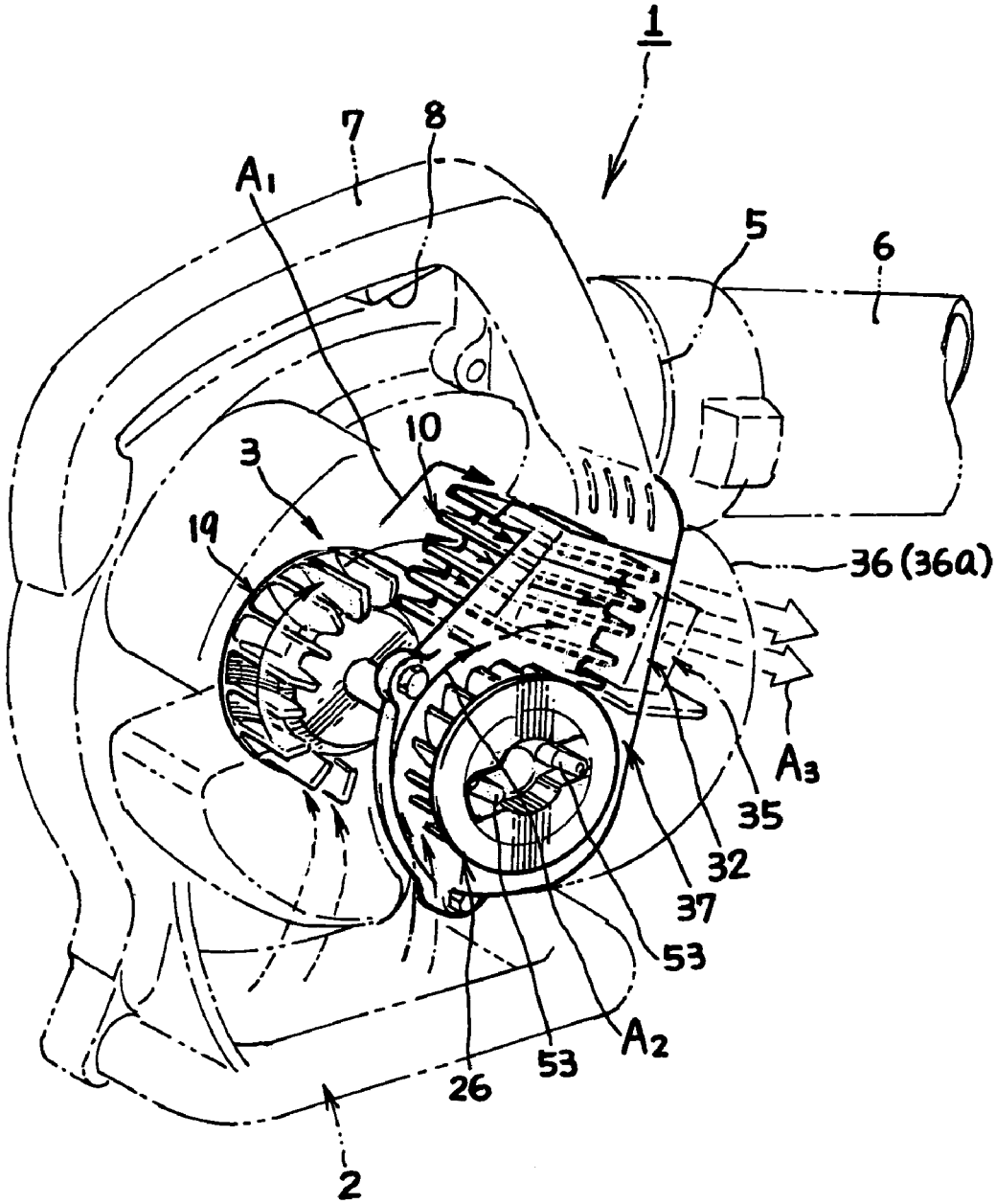
FIG. 3 is a schematic perspective view showing flows of cooling air supplied by first and second fans.

Reference is now made to FIG. 3. The side guide 32 cooperates with the cylinder cover 24, which acts as an air flow guide along with the upper wall portion 34 of a starter case 33 (which has no opening on an outer side surface thereof and which is described later with reference to FIG. 2). This air flow guide causes the air flow A2 generated by the second fan 26 to flow together with the air flow A1 generated by the first fan 19 downstream of the cylinder 10 after the cylinder 10 is cooled by the air flow A1, and guides the confluent air flow (confluent cooling air) A3 to an exhaust muffler 35 of the internal combustion engine 9. Accordingly, since the exhaust muffler 35 is cooled by the confluent cooling air A3, it can be cooled effectively.

As shown in FIG. 1, the exhaust muffler 35 is disposed such that when the worker W carries out an ordinary air supply job by gripping the handle 7 with one hand and directing the blower pipe 6 forwardly obliquely downward, an exhaust gas and the confluent cooling air A3 are exhausted forward of the worker W from a slit-shaped exhaust port 36*a* formed to a muffler cover 36 located on the front surface of the machine body 2. Therefore, even if the worker W uses the powered blower by positioning the machine body 2 on the right side of his or her body while gripping the handle 7 with a right hand or by positioning the machine body 2 on the left side of his or her body while gripping the handle 7 with a left hand, the worker W can be prevented from coming under the exhaust gas. As another embodiment, the exhaust port 36*a* and the exhaust muffler 35 may be disposed in a direction where the exhaust gas and the like are exhausted rearward of the worker W in the ordinary air supply job.

Figure 4:
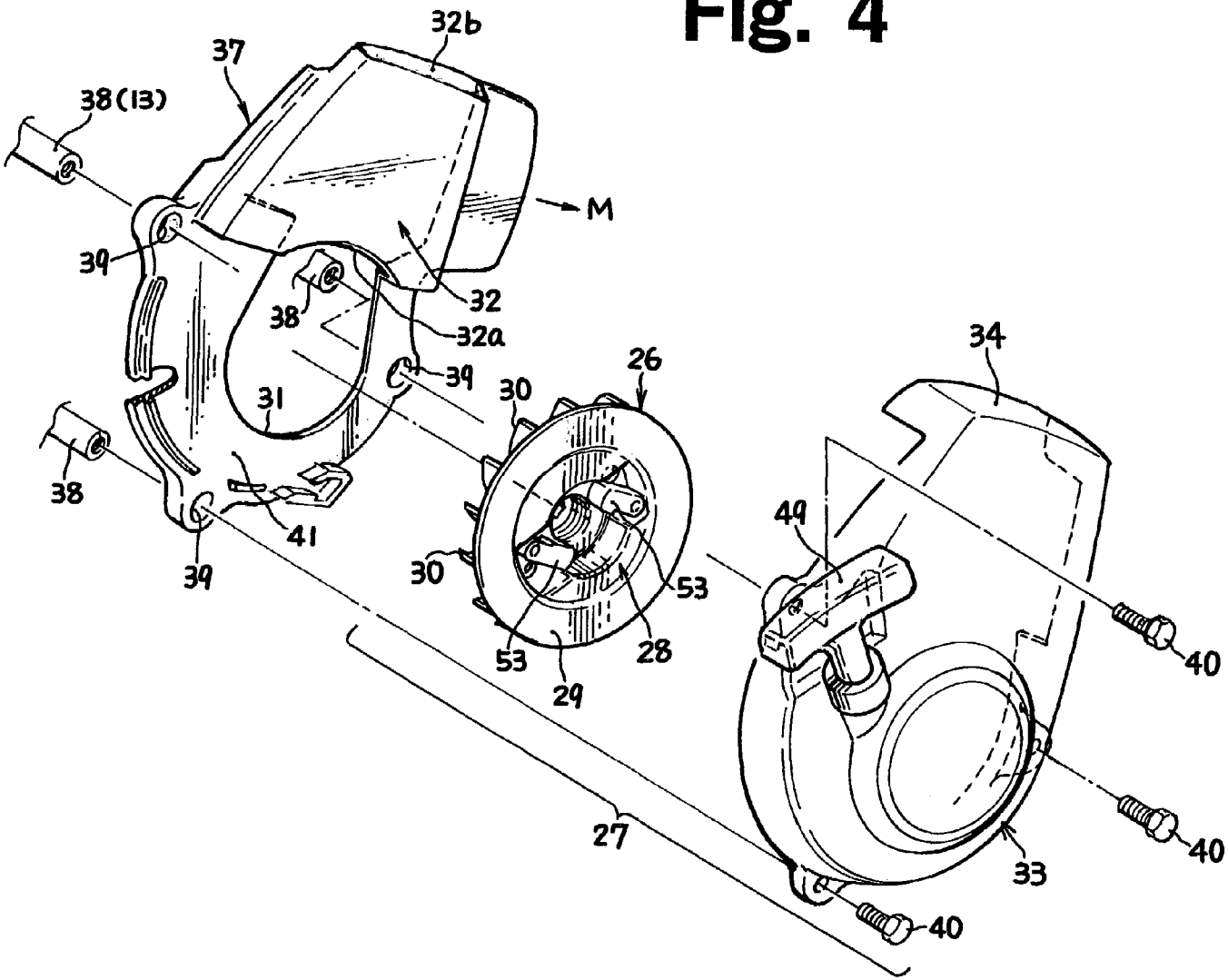
FIG. 4 is an exploded perspective view showing an adaptor having a side guide, the second fan, and a starter case.

As shown in FIG. 4, the side guide 32 is formed as a part of an adaptor 37 detachably attached to the crank case 13. The adaptor 37 has attachment holes 39 for receiving a plurality of attachment projections 38 formed to the crank case 13 integrally therewith. The adaptor 37 is fixed to the starter case 33 by plug bolts 40 screw-coupled with the attachment holes 39 after the adaptor 37 is attached to the crank case 13 and the starter case 33 is attached to the adaptor 37.

As shown in FIG. 2, when the adaptor 37 is attached to the crank case 13, the lower end 32*a* of the side guide 32 is located externally of the right side of the disc 29 of the second fan 26, and the upper end 32*b* of the side guide 32 is located at a position approximately as high as the upper surface of a cylinder head 10*b*. Then, the inner surface 32*c* of the side guide 32 acting as an air flow guide surface confronts the right outer surface 10*a* of the cylinder 10 as well as extends in the direction M of the exhaust muffler 35 as shown in FIG. 4.

As will be seen from FIGS. 2 and 4 when they are taken together, a partition wall 41, which partitions the crank case 13 from and the second blades 30, is formed to the adaptor 37 integrally therewith, in addition to the side guide 32. The partition wall 41 is disposed near to the second blades 30, and the lower portion of the partition wall 41 forms the intake port 31 between it and the crank case 13. The rotation of the second fan 26 causes the air outside of the intake port 31 to bypass the partition wall 41 and to be intaken to the second blades 30 side from a narrow gap between the partition wall 41 and the second blades 30. Accordingly, the air intake efficiency and the air supply efficiency of the second fan 26 are improved, thereby improving the cooling property of the cylinder 10. The partition wall 41 forms an intake chamber 42 between it and the disc 29 of the second fan 26 as well as acts as an air supply guide for guiding the air flow intaken by the second blades 30 to the side guide 32 without escaping it.

The ambient air intaken from the second intake port 31 by the rotation of the second fan 26 also contributes to cooling the right outer side surface 13*a* of the crank case 13 as well as contributes to cooling a seal member 43 attached to a bearing portion between the crank case 13 and the crankshaft 12. Further, since the intake chamber 42 is interposed between the crank case 13 and the recoil starter 27, the intake chamber 42 acts as a heat insulation chamber. This is advantageous in that the recoil starter 27 of the machine body 2 can be effectively protected from the heat on the crank case 13 side.

As shown in FIG. 2, the recoil starter 27 is arranged in a well-known manner and includes a starter reel 44 disposed in confrontation with the ratchet pawl holder 28. The starter reel 44 is rotatably supported in the starter case 33 that can be fixed to the crank case 13 together with the adaptor 37. More specifically, a reel support shaft 45, which is located on the same axial line X as the ratchet pawl holder 28, projects from the center of the starter case 33 on the inner surface side thereof, a boss portion 46 of the starter reel 44 is rotatably fitted on the reel support shaft 45 and rotatably fixed by a set screw 47. A starter rope 48 is wound around the starter reel 44, and a wind-up spring 50 is interposed between the starter reel 44 and the inner surface of the starter case 33. The wind-up spring 50 automatically returns and rotates the starter reel 44 in a winding direction of the starter reel 44 after the starter rope 48 is drawn out by a starter handle 49. A boss extending portion 51 is formed by extending the boss portion 46 of the starter reel 44 to the ratchet pawl holder 28 side, and a ratchet cam 52 is formed to the outer periphery of the boss extending portion 51 integrally therewith to rotate the ratchet pawl holder 28.

In contrast, a centrifugal ratchet pawl 53 is swingably attached to the ratchet pawl holder 28 which is fixed to the right end 12R of the crankshaft 12 so as to prevent its rotation. The centrifugal ratchet pawl 53 is engaged with the ratchet cam 52. The centrifugal ratchet pawl 53 is ordinarily kept by a return spring 54 at an inward position where it is engaged with the ratchet cam 52. When the worker W pulls the starter handle 49 coupled with the starter rope 48, the ratchet pawl holder 28, that is, the crankshaft 12 is rotated through the ratchet cam 52 and the centrifugal ratchet pawl 53 engaged with each other by the rotation of the starter reel 44, thereby the piston 11 is reciprocated up and down. When the internal combustion engine 9 is started by a known mechanism, the centrifugal ratchet pawl 53 is thrown externally against the urging force of the return spring 54 by centrifugal force generated by the crankshaft 12 rotating at high speed. As a result, the centrifugal ratchet pawl 53 is automatically disengaged from the ratchet cam 52.

Incidentally, as already described with reference to FIG. 2, the magneto rotor 16 and the centrifugal fan 17 are fixed to the left end 12L of the crankshaft 12. As is well-known, the magneto rotor 16 has a large weight because it includes the magnet 22. Likewise, the centrifugal fan 17 also has a large weight because it is formed in a large size so that it can deliver a strong air flow used for an air supply job. In contrast, the total weight of the ratchet pawl holder 28 fixed to the right end 12R of the crankshaft 12 and that of the centrifugal ratchet pawl 53 is relatively much smaller. Accordingly, in the conventional internal combustion engine that does not have the second fan 26, large uneven loads having a large difference act on the crankshaft 12 along the axial line X thereof on both the right and left sides of the reciprocating axial line Y of the piston 11. When the crankshaft 12 rotates at high speed in this state, since a large swing is generated on the heavily loaded side of the crankshaft 12, that is, on the left end 12L side, the hand-held power blower 1 is greatly vibrated when it is operated, thereby a job carried out while holding the power blower 1 with a hand is made uncomfortable, and fatigue is often experienced when the device is continuously used for a long time.

In contrast, in the embodiment of the present invention, the swing of the crankshaft 12 can be reduced since the ratchet pawl holder 28 also acts as the second fan 26. In addition, the unbalance between the right and left loads is corrected by at least the weight of the disc 29 and the weight the multiplicity of second blades 30. More specifically, the second fan 26 not only cools the muffler cover 36 of the power unit 3, the starter case 33, and the like, but also acts as a balancer for keeping the balance of the crankshaft 12 on the right and left sides thereof. Accordingly, it is preferable that the weight of the second fan 26 be set to a proper value within the range of the allowable overall weight of the power blower 1 such that the second fan 26 may effectively act as the balancer.

Further, since no opening is formed on the outer side surfaces of the starter case 33, rain water and the like is prevented from entering the recoil starter 27. This arrangement is preferable to avoid defective operation of the power blower.

What is claimed is:

1. A power unit including an air-cooled internal combustion engine comprising:

a first fan coupled with an end of a crankshaft of the internal combustion engine for cooling at least a cylinder of the internal combustion engine;

a second fan coupled with another end of the crankshaft for cooling at least the cylinder;

an intake port interposed between a crank case for rotatably supporting the crankshaft and the second fan, the second fan includes a disc fixed to the crankshaft and a multiplicity of blades formed on the surface of the disc on the crank case side thereof, wherein the second fan also acts as a ratchet pawl holder for transmitting the rotation of a starter reel including a recoil starter and a starter case rotatably supporting the starter reel is attached to an adaptor, the starter case devoid of holes on an outer surface thereof, the adaptor including a partition wall and at least a part of the air flow guide integrally therewith, the partition wall disposed adjacent the blades to partition between the crank case and the blades and to form the intake port between it and the crank case; and an air flow guide for causing air flow generated by the second fan to flow together with air flow generated by the first fan after it cools the cylinder as well as guiding a resulting confluent air flow to an exhaust muffler of the internal combustion engine.

2. An internal combustion engine in combination with a working machine, the internal combustion engine comprising:

a cylinder with a piston disposed therein;

a crankshaft connected to the piston, the crankshaft having a first end and a second end, the first end of the crankshaft having connected thereto a first fan for cooling the cylinder, and the second end of the crankshaft having connected thereto a second fan also for cooling the cylinder, wherein the second fan is arranged integrally with a ratchet pawl holder for transmitting the rotation of a starter reel comprising a recoil starter; and an air flow guide configured to cause air flow generated by the second fan to flow together with air flow generated by the first fan after it cools the cylinder as well as guiding a resulting confluent air flow to an exhaust muffler of the internal combustion engine.

3. The internal combustion engine of claim 2, wherein the working machine is an air blower.

4. The internal combustion engine of claim 2, wherein a weight of the second fan balances out vibrations caused primarily by the first fan.

* * * * *